US005791421A

United States Patent [19]

Lin

[11] Patent Number: 5,791,421

[45] Date of Patent: Aug. 11, 1998

[54] OPTIMAL MATERIAL PAIR FOR METAL FACE SEAL IN EARTH-BORING BITS

[75] Inventor: Chih Lin, Spring, Tex.

[73] Assignee: Baker Hughes Incorporated, Houston, Tex.

[21] Appl. No.: 692,939

[22] Filed: Aug. 6, 1996

[51] Int. Cl.[6] ..... E21B 10/24

[52] U.S. Cl. ..... 175/371; 175/227; 277/83

[58] Field of Search ..... 175/227, 367, 175/228, 371, 372, 374, 337; 277/83, 92

[56] References Cited

U.S. PATENT DOCUMENTS

| | | | |
|---|---|---|---|
| 3,086,782 | 4/1963 | Peickii et al. | 277/92 |
| 4,249,622 | 2/1981 | Dysart | 175/227 |
| 4,516,641 | 5/1985 | Burr | 175/228 |
| 4,666,001 | 5/1987 | Burr | 175/371 |
| 4,753,303 | 6/1988 | Burr | 175/367 |
| 4,822,057 | 4/1989 | Chia et al. | 277/84 |
| 4,838,365 | 6/1989 | Kotch | 175/371 |
| 4,923,020 | 5/1990 | Kelly, Jr. et al. | 175/372 |
| 5,295,549 | 3/1994 | Dolezal et al. | 175/371 |
| 5,360,076 | 11/1994 | Kelly, Jr. et al. | 175/371 |
| 5,402,858 | 4/1995 | Quantz et al. | 175/371 |
| 5,485,890 | 1/1996 | Cawthorne et al. | 175/228 |

FOREIGN PATENT DOCUMENTS

| | | |
|---|---|---|
| 0 335 497 A2 | 10/1989 | European Pat. Off. . |
| 2 225 602 | 6/1990 | United Kingdom . |
| 2 278 865 | 12/1994 | United Kingdom . |
| 2 288 617 | 10/1995 | United Kingdom . |
| 2 290 323 | 12/1995 | United Kingdom . |

OTHER PUBLICATIONS

"Reducing Wear in Machines", BIRL Technology Bulletin, date unknown, 4 pages.

"New Supernexus Coatings", S.I. Diamond Technology, Inc., date unknown, 3 pages.

"Drill Bit Catalog", Hughes Christensen, 1994, 6 pages.

*Primary Examiner*—Frank Tsay
*Attorney, Agent, or Firm*—Charles D. Gunter, Jr.

[57] ABSTRACT

An earth-boring bit has a bit body, at least one cantilevered bearing shaft, including a base and a cylindrical journal bearing surface extending inwardly and downwardly from the bit body, and at least one cutter mounted for rotation on the cylindrical journal bearing surface of the bearing shaft. A seal assembly is disposed between the cylindrical journal bearing surface and the cutter proximally to the base of the cantilevered bearing shaft. The seal assembly includes at least one rigid seal ring having a seal face in contact with a second seal face. A selected one of the seal faces is at least partially formed of a hard ceramic type material with the other seal face being formed of a relatively softer material to provide improved wear resistance for the seal assembly.

10 Claims, 6 Drawing Sheets

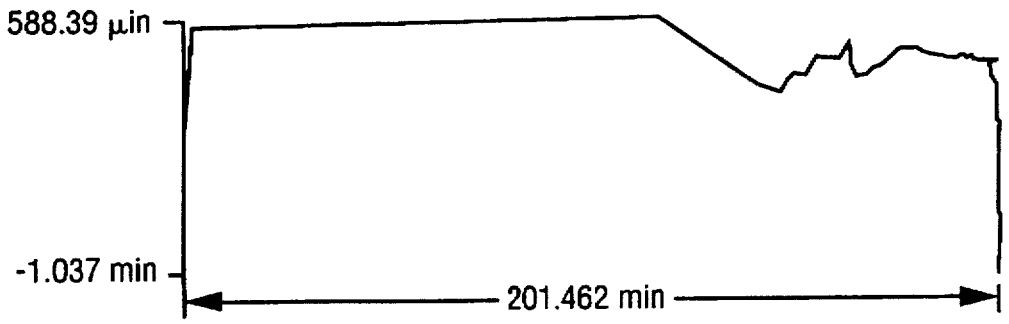
*FIG. 4* Profile of the 440C head seal from Test #22.
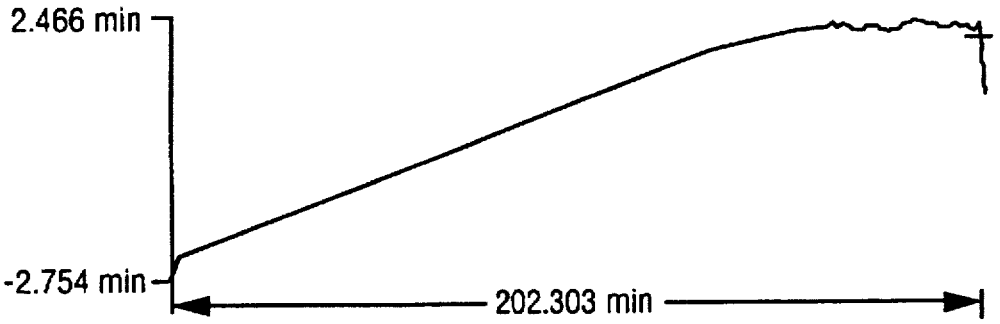
*FIG. 5* Profile of the 440C cone seal from Test #23.

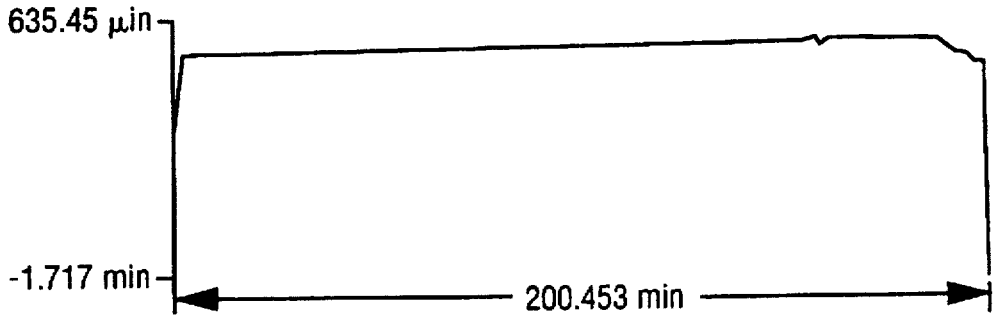
*FIG. 6* Profile of the TiN coated head seal fromTest #23.
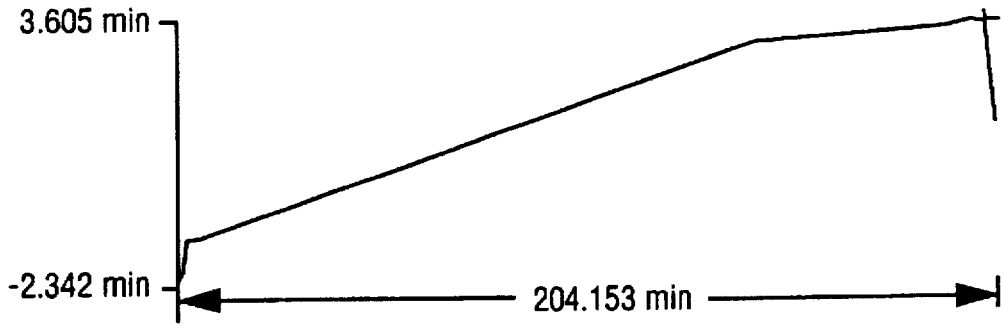
*FIG. 7* Profile of the 440C cone seal from Test #23.

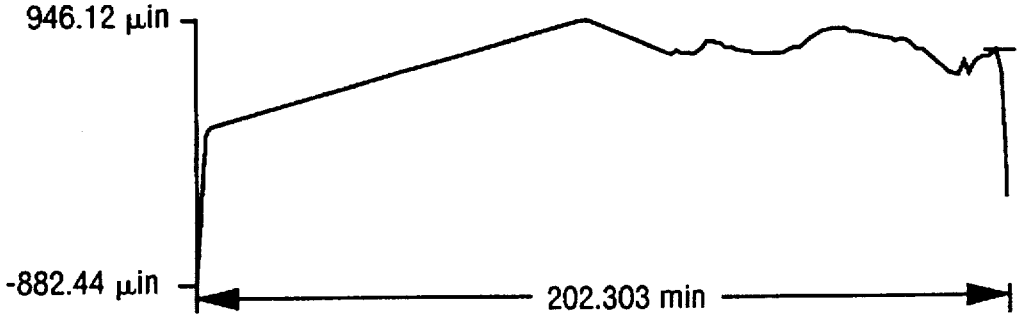
*FIG. 8* Profile of the 440C head seal fromTest #24.
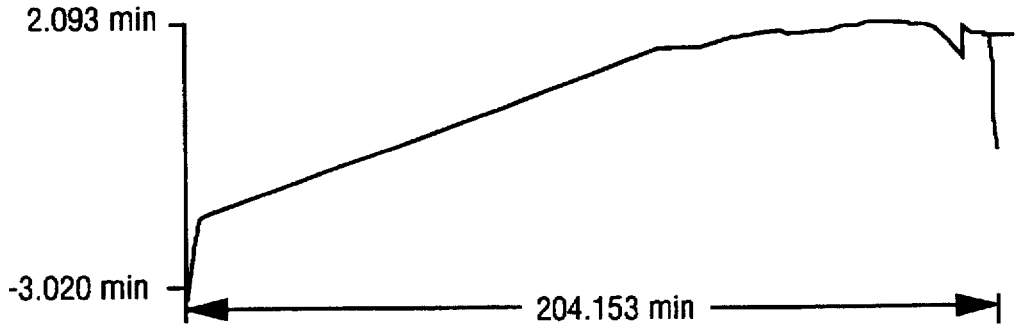
*FIG. 9* Profile of the 440C cone seal fromTest #24.

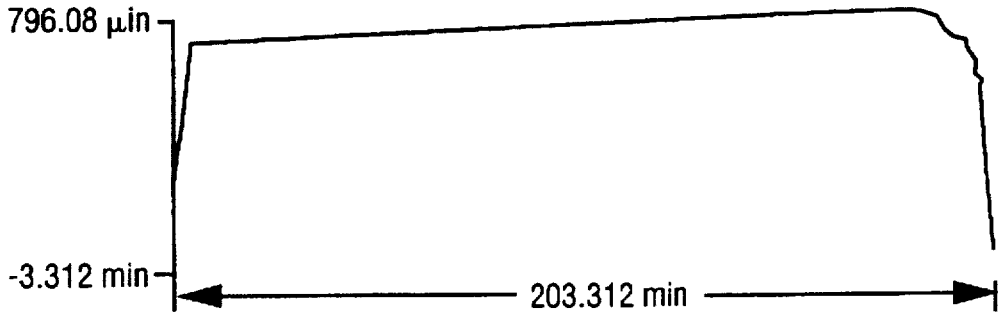
*FIG. 10* Profile of the TiN coated head seal fromTest #25.
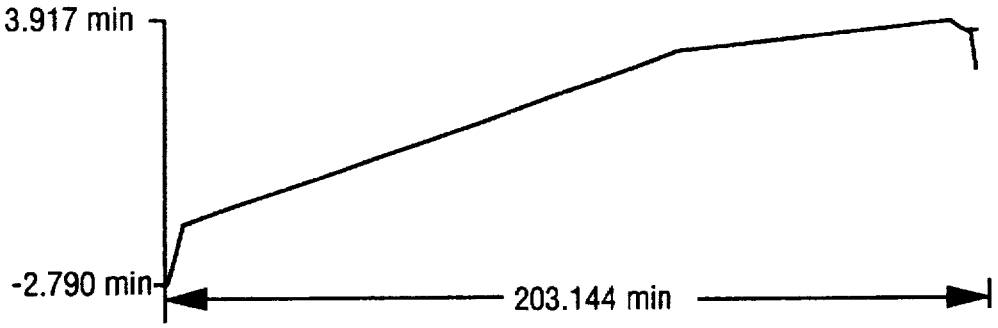
*FIG. 11* Profile of the 440C cone seal from Test #25.

OPTIMAL MATERIAL PAIR FOR METAL FACE SEAL IN EARTH-BORING BITS

BACKGROUND OF THE INVENTION

1. Field of the Invention

The present invention relates generally to earth-boring bits, especially the seal and lubrication systems for earth-boring bits of the rolling cutter variety. More specifically, the present invention relates to improving the wear resistance on the sealing surfaces, to maintaining an optimal geometry for high sealing efficiency and to retarding the corrosion on the sealing surfaces of such earth-boring bits.

2. Description of the Prior Art

The success of rotary drilling enabled the discovery of deep oil and gas reservoirs. The rotary rock bit was an important invention that made the success of rotary drilling possible. Only soft earthern formations could be penetrated commercially by the earlier drag bit, but the two-cone rock bit, invented by Howard R. Hughes, U.S. Pat. No. 930,759, drilled the hard cap rock at the Spindletop Field, near Beaumont, Tex. with relative ease. Many advances have since contributed to the impressive improvement of earth-boring bits of the rolling cutter variety.

In drilling boreholes in earthen formations by the rotary method, earth-boring bits typically employ at least one rolling cone cutter, rotatably mounted thereon. The bit is secured to the lower end of a drillstring that is rotated from the surface or by downhole motors. The cutters mounted on the bit roll and slide upon the bottom of the borehole as the drillstring is rotated, thereby engaging and disintegrating the formation material. The rolling cutters are provided with teeth that are forced to penetrate and gouge the bottom of the borehole by weight from the drillstring.

As the cutters roll and slide along the bottom of the borehole, the cutters, and the shafts on which they are rotatably mounted, are subjected to large static loads from the weight on the bit, and large transient or shock loads encountered as the cutters roll and slide along the uneven surface of the bottom of the borehole. Thus, most earth-boring bits are provided with precision-formed journal bearings and bearing surfaces, as well as sealed lubrication systems to increase drilling life of bits. The lubrication systems typically are sealed to avoid lubricant loss and to prevent contamination of the bearings by foreign matter such as abrasive particles encountered in the borehole. A pressure compensator system minimizes pressure differential across the seal so that lubricant pressure is equal to or slightly greater than the hydrostatic pressure in the annular space between the bit and the sidewall of the borehole.

Early Hughes bits had no seals or rudimentary seals with relatively short life, and, if lubricated at all, necessitated large quantities of lubricant and large lubricant reservoirs. Typically, upon exhaustion of the lubricant, journal bearing and bit failure soon followed. An advance in seal technology occurred with the "Belleville" seal, as disclosed in U.S. Pat. No. 3,075,781, to Atkinson et al. The Belleville seal minimized lubricant leakage and permitted smaller lubricant reservoirs to obtain acceptable bit life.

During the quest for improved journal bearing seals, bits employing anti-friction ball or roller bearing elements rose to prominence in bit technology. Roller bearing elements reduce the importance of lubricants and lubrication systems but introduce a number of other disadvantages. A principal disadvantage is that a failure of any one of the numerous elements likely would permit metallic particles to enter the bearing with almost certain damaging results.

An adequately sealed journal-bearing bit should have greater strength and load-bearing capacity than an anti-friction bearing bit. The seal disclosed by Atkinson would not seal lubricant inside a journal-bearing bit for greater than about 50–60 hours of drilling, on average. This was partially due to the rapid movement of the cutter on its bearing shaft (cutter wobble), necessitated by bearing and assembly tolerances, which causes dynamic pressure surges in the lubricant, forcing lubricant past the seal, resulting in premature lubricant loss and bit failure.

The O-ring, journal bearing combination disclosed in U.S. Pat. No. 3,397,928, to Galle unlocked the potential of the journal-bearing bit. Galle's O-ring-sealed, journal-bearing bit could drill 100 hours or more in the hard, slow drilling of West Texas. The success of Galle's design was in part attributable to the ability of the O-ring design to help minimize the aforementioned dynamic pressure surges.

A major advance in earth-boring bit seal technology occurred with the introduction of a successful rigid face seal. The rigid face seals used in earth-boring bits are improvements upon a seal design known as the "Duo-Cone" seal, developed by Caterpillar Tractor Co. of Peoria, Ill. Rigid face seals are known in several configurations but typically comprise at least one rigid ring, having a precision seal face ground or lapped thereon, confined in a groove near the base of the shaft on which the cutter is rotated, and an energizer member, which urges the seal face of the rigid ring into sealing engagement with a second seal face. Thus, the seal faces mate and rotate relative to each other to provide a sealing interface between the rolling cutter and the shaft on which it is mounted. The seals or rings are referred to as being "rigid" in comparison to, for example, an o-ring seal.

The combination of the energizer member and rigid ring permits the seal assembly to move slightly to minimize pressure fluctuations in the lubricant, and to prevent extrusion of the energizer past the cutter and bearing shaft, which can result in sudden and almost total lubricant loss. U.S. Pat. Nos. 4,516,641, to Burr; 4,666,001, to Burr; 4,753,304, to Kelly; and 4,923,020, to Kelly, are examples of rigid face seals for use in earth-boring bits. Rigid face seals substantially improve the drilling life of earth-boring bits of the rolling cutter variety. Earth-boring bits with rigid face seals frequently retain lubricant and thus operate efficiently longer than prior-art bits.

Because the seal faces of rigid face seals are in constant contact and slide relative to each other, one mode of failure of the seals is wear. Eventually, the seal faces become pitted and the frictional forces between the seal faces increase, leading to increased operating temperatures, reduction in sealing efficiency and eventual seal failure, which ultimately results in bit failure. In an effort to minimize seal wear, seal rings of the prior-art rigid face seals are constructed of tool steels such as 440 C stainless, or hardenable alloys such as Stellite. Use of these materials in rigid face seals lengthens the drilling life of bits but leaves room for improvement of the drilling longevity of rigid face seals, and thus earth-boring bits.

A need exists, therefore, for a rigid face seal for use in earth-boring bits having improved wear resistance in the seal faces of the rigid face seals which are in constant contact and slide relative to each other.

A need also exists for an improved rigid face seal for use in earth-boring bits which has high sealing efficiency to prevent contaminants from entering the bit system which the seal protects.

A need also exists for such an improved rigid face seal which is configured to retard corrosion on the sealing surfaces of the seal system.

A need exists for a face seal used in an earth boring bit having improved stiffness at the sealing surfaces.

SUMMARY OF THE INVENTION

It is a general object of the present invention to provide an improved rigid face seal for use in an earth-boring bit, the rigid face seal having improved wear-resistance between the seal faces thereof improved sealing efficiency and improved corrosion resistance.

This and other objects of the present invention are accomplished by providing an earth-boring bit having a bit body, at least one cantilevered bearing shaft, including a cylindrical journal bearing surface extending inwardly and downwardly from the bit body, and at least one cutter mounted for rotation on the cylindrical journal bearing surface of the bearing shaft. A seal assembly is disposed between the cylindrical journal bearing surface and the cutter proximally to the base of the cantilevered bearing shaft. The seal assembly includes at least one rigid seal ring having a seal face in contact with a second seal face, at least one of the seal faces being at least partially formed of a hard ceramic type material.

According to the preferred embodiment of the present invention, the first seal face is formed of a hard ceramic type material and the second seal face is a radial seal face on a second rigid seal ring, the second seal face being formed of a relatively softer material than the hard ceramic type material on the first rigid seal ring.

According to one embodiment of the present invention, the second seal face is carried by the cutter of the earth-boring bit, the second seal face being formed of a relatively softer material than the hard ceramic material on the first rigid seal ring.

The hard ceramic type material is preferably selected from the group consisting of metal nitrides, metal carbides, carbon nitrides and nitride superlattices. The relatively softer, second seal face can be formed of a metal selected from the group consisting of iron and cobalt and alloys thereof.

Other objects, features and advantages of the present invention will be apparent to those skilled in the art with reference to the figures and detailed description, which follow.

BRIEF DESCRIPTION OF THE DRAWINGS

FIGS. 4–11 are graphical comparisons of the results of tests of various pairs of rigid seal rings coated according to the present invention versus conventional materials showing the surface profiles thereof.

DETAILED DESCRIPTION OF THE INVENTION

Figure 1:
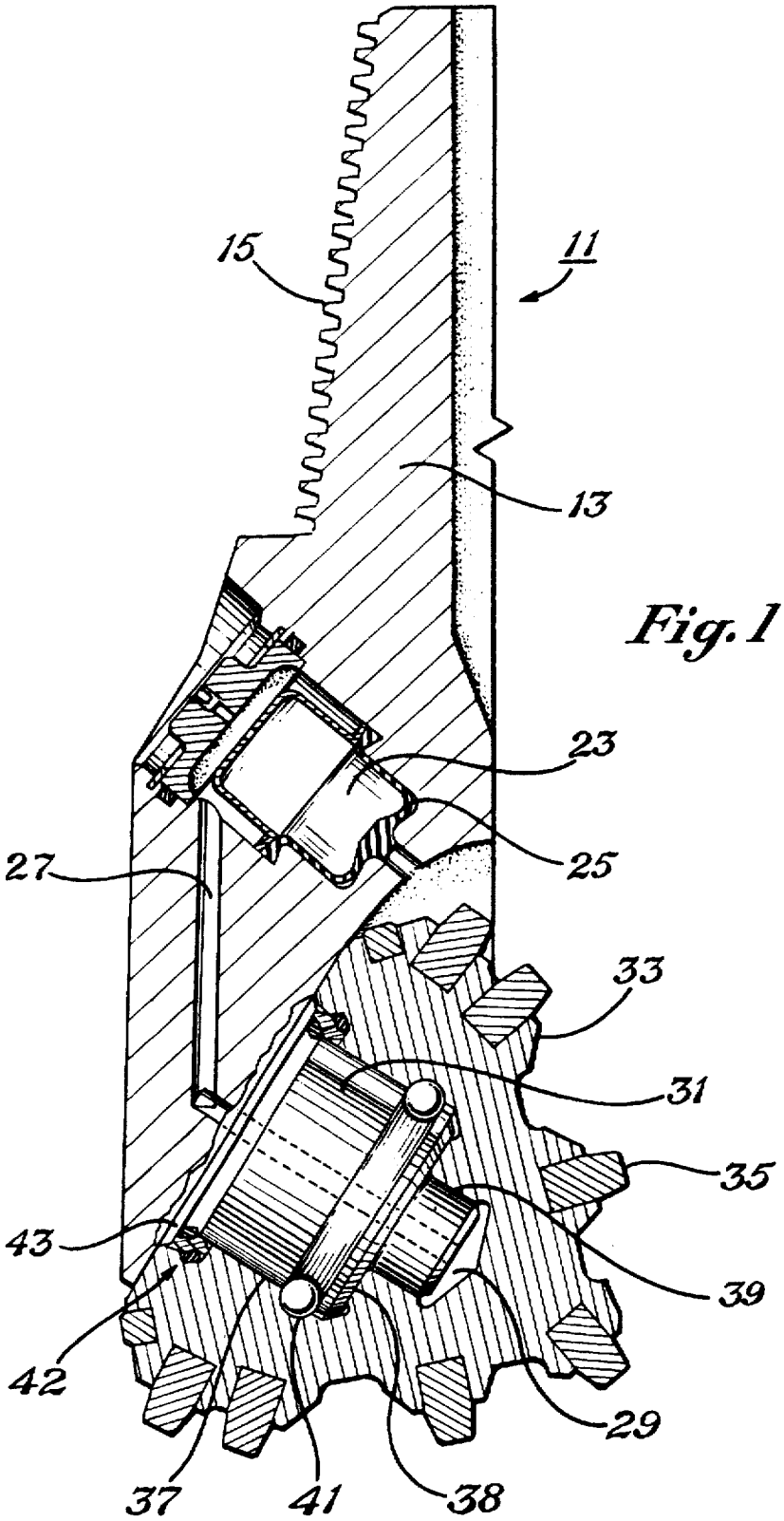
FIG. 1 is a fragmentary section view of a section of an earth-boring bit according to the present invention.

FIG. 1 depicts, in fragmentary section view, one section of an earth-boring bit 11 according to the present invention. Earth-boring bit 11 is provided with a body 13, which is threaded at its upper extent 15 for connection into a drill-string (not shown).

Earth-boring bit 11 is provided with a pressure compensating lubrication system 23. Pressure compensating lubrication system 23 is vacuum pressure filled with lubricant at assembly. The vacuum pressure lubrication process also ensures that the journal bearing cavity generally designated as 29 is filled with lubricant through passage 27. Ambient borehole pressure acts through diaphragm 25 to cause lubricant pressure to be substantially the same as ambient borehole pressure.

A cantilevered bearing shaft 31 extends inwardly and downwardly from body 13 of earth-boring bit 11. A generally frusto-conical cutter 33, sometimes referred to as a "cone", is rotatably mounted on a cantilevered bearing shaft 31. Cutter 33 is provided with a plurality of generally circumferential rows of inserts or teeth 35, which engage and disintegrate formation material as earth-boring bit 11 is rotated and cutters 33 roll and slide along the bottom of the borehole.

Cantilevered bearing shaft 31 is provided with a cylindrical bearing surface 37, a thrust bearing surface 38, and a pilot pin bearing surface 39. These surfaces 37, 38, 39 cooperate with mating bearing surfaces on cutter 33 to form a journal bearing on cantilevered bearing shaft 31 on which cutter 33 may rotate freely. Lubricant is supplied to journal bearing through passage 27 by pressure-compensating lubricant system 23. Cutter 33 is retained on bearing shaft 31 by means of a plurality of precision-ground ball locking members 41.

A seal assembly 42 according to the present invention is disposed proximally to a base 43 of cantilevered bearing shaft 31 and generally intermediate cutter 33 and bearing shaft 31. The seal assembly is provided to retain the lubricant within bearing cavity 29, and to prevent contamination of lubricant by foreign matter from the exterior of the bit 11. The seal assembly may cooperate with pressure-compensating lubricant system 23 to minimize pressure differentials across seal 42, which can result in rapid extrusion of and loss of the lubricant, as disclosed in U.S. Pat. No. 4,516,641, to Burr. Thus, pressure compensator 23 compensates the lubricant pressure for hydrostatic pressure changes encountered by bit 11, while seal assembly 42 compensates for dynamic pressure changes in the lubricant caused by movement of the cutter 33 on shaft 31.

Figure 2:
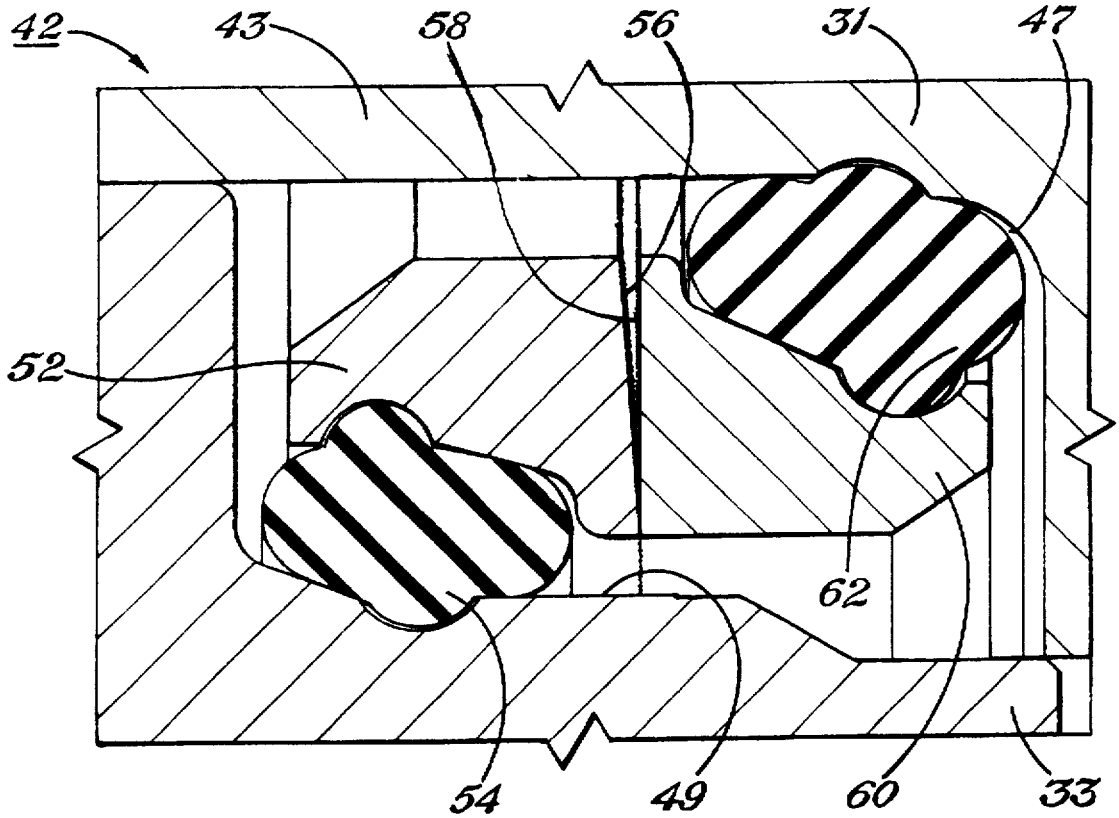
FIG. 2 is an enlarged, fragmentary section view of the preferred seal assembly for use with earth-boring bits according to the present invention.

FIG. 2 depicts, in enlarged section view, a preferred seal configuration 42 contemplated for use with the present invention. Seal assembly 42 illustrated is known as a "dual" rigid face seal because it employs two rigid seal rings, as opposed to the single-ring configuration illustrated in FIG. 3. Dual rigid face seal assembly 42 is disposed proximally to base 43 of bearing shaft 31 and is generally intermediate cutter 33 and shaft 31. Seal assembly 42 is disposed in a seal groove defined by shaft groove 47 and cutter groove 49. Dual rigid face seal assembly 42 comprises a cutter rigid ring 52, a cutter resilient energizer ring 54, shaft rigid ring seal ring 60, and shaft resilient energizer ring 62. Cutter rigid seal ring 52 and shaft rigid seal ring 60 are provided with precision-formed radial seal faces 56, 58, respectively. Resilient energizer rings 54, 62 cooperate with seal grooves 47, 49 and rigid seal rings 52, 60 to urge and maintain radial seal faces 56, 58 in sealing engagement. The seal interface formed by seal faces 56, 58 provides a barrier that prevents lubricant from exiting the journal bearing, and prevents contamination of the lubricant by foreign matter from exterior of bit 11.

Figure 3:
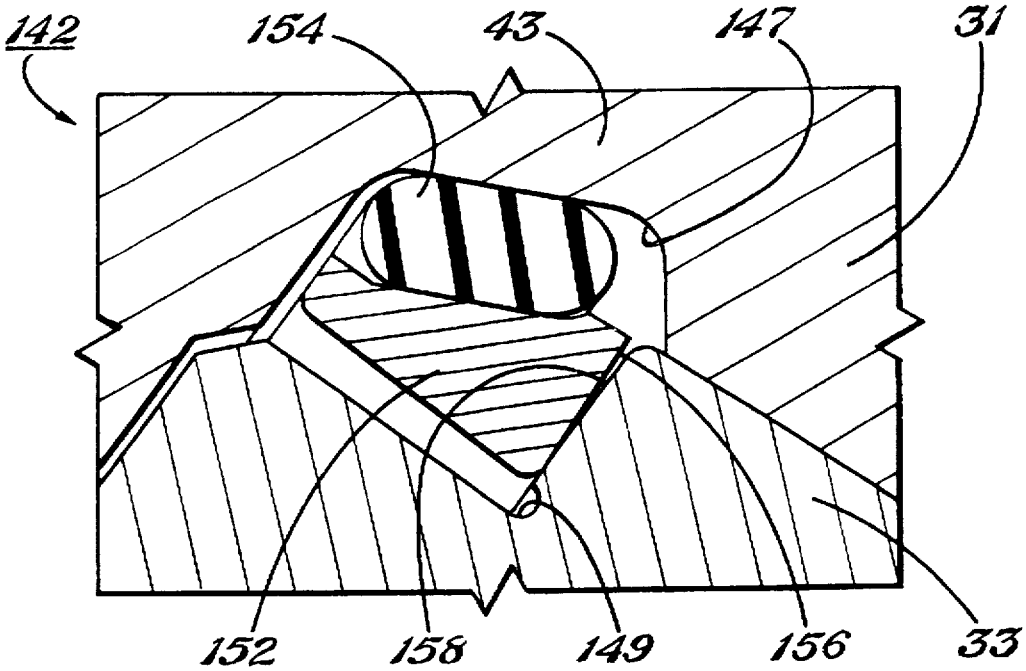
FIG. 3 is an enlarged, fragmentary section view of an alternative seal assembly contemplated for use with the present invention.

As seen in FIGS. 2 and 3, the radial seal faces 58, 158 are relatively flat surfaces. The radial seal faces 56, 156 are formed with a spherical radius leading to a flat which gives the surface a slight taper. Exemplary dimensions for the seal assemblies depicted in FIGS. 2 and 3 may be found in issued U.S. Pat. Nos. 4,516,641 to Burr and 4,753,304 to Kelly, respectively.

According to the preferred embodiment of the present invention, at least a portion of a selected seal face 56, 58 of rigid seal rings 52, 60 is formed of a hard ceramic type material. Preferably, the entirety of one selected seal face 56, 58 is formed of the hard ceramic type material. The other of the rigid seal faces 56, 58 is formed of a relatively softer material than the hard ceramic type material of the first rigid seal ring. The use of a hard ceramic type material on one seal face and a relatively softer material for the other seal face reduces wear on the seal faces 56, 58, thereby enhancing the life of the seal assembly 42.

In the preferred embodiment of the invention shown in FIG. 2, the relatively flat, head seal surface (58 in FIG. 2) is formed of the hard ceramic type material and the tapered, cone seal surface (56 in FIG. 2) is formed of the relatively softer material.

FIG. 3 illustrates, in enlarged section view, an alternative seal configuration 142. Seal assembly 142 comprises shaft seal groove 147, cutter seal groove 149, rigid seal ring 152, and resilient energizer ring 154. A precision-formed radial seal face 156 is formed on rigid seal ring 152, and mates with a corresponding precision formed seal face 158 carried by cutter 33. Resilient energizer ring 154 cooperates with shaft seal groove 147 and rigid seal ring 152 to urge and maintain seal faces 156, 158 in sealing engagement. At least a portion, and preferably the entirety of a selected seal face 156, 158 of seal assembly 142 is formed of a hard ceramic type material which is harder than the other of the seal faces.

In the preferred embodiment of the invention shown in FIG. 3, the relatively flat seal surface (158 in FIG. 3) is formed of the hard ceramic type material and the tapered seal surface (156 in FIG. 3) is formed of the relatively softer material. While the relatively softer seal surface 156 incurs more wear, it more nearly maintains its desired geometry in the arrangement of the invention.

The seal assemblies depicted in FIGS. 1, 2 and 3 are representative of rigid face seal technology and are shown for illustrative purposes only. The utility of the present invention is not thus limited to the seal assemblies illustrated but is useful in all manner of face seals used in earth boring bits. In each case, the flat seal face could be on either the cone or head seal face, or both seal faces could be flat.

The relatively harder material chosen for a selected seal face of the seal system of the invention can be a hard ceramic type material. By "hard ceramic type material" is meant a material preferably selected from the group consisting of metal nitrides, metal carbides, carbon nitrides and nitride superlattices. The hard surface can be obtained, for example, by physical vapor deposition (PVD) or chemical vapor deposition (CVD) coating with a hard ceramic material such as TiN, TiC, CrN, ZrN, NbN, etc. It can also be brazed in as a layered composite. The relatively softer second seal face of the sealing system of the invention can be a material selected from the group consisting of iron and cobalt and alloys thereof, such as tempered stainless steel, or a hardenable alloy such as Stellite.

In the tests which follow, the harder seal face was formed by coating the sealing face of a standard 440 C seal ring with a thin ceramic coating of TiN by a process developed at the Basic Industrial Research Laboratory (BIRL) at Northwestern University. The TiN coatings were made by a high-rate reactive sputtering technique. In this technique, titanium is deposited by a standard dc magnetron, fed with a mixture of argon and nitrogen to form TiN. The nitrogen partial pressure is controlled by a feedback loop, thereby ensuring proper coating chemistry, while maintaining a high deposition rate of typically about 0.5 microns/minute (0.00002 inches/minute). This coating method is versatile and can be done at lower temperatures than most other TiN deposition methods. Satisfactory adhesion is achieved even with a 440 C steel substrate as the target surface and hardness is generally about 2000 HV. Most TiN coatings used to reduce wear in industrial tooling are about 2.5 microns thick, but thinner coatings have been provided through the BIRL process in the range from about 0.25 to 2.5 microns. A coating thickness of in the range from about 2–8 microns, more preferably about 4–7 microns is generally preferred for purposes of the present invention. The described coatings are commercially available by virtue of a recently installed commercial-size arc-bond sputter deposition system at the Basic Industrial Research Laboratory at Northwestern University.

Other techniques for depositing a hard ceramic coating include physical vapor deposition, chemical vapor deposition, thermal spray, electroplating and laser surface treatments, for example, and will be familiar to those skilled in the art.

Carbon nitride is another hard ceramic type material which is available from BIRL in the same type thickness ranges. The carbon nitride ($C_3N_4$) can be provided by reactive dc magnetron sputtering, sputter etching techniques, reactive deposition ($Ar/N_2$ or $N_2$ atmospheres), substrate biasing techniques (dc, rf, or DC pulse), etc.

The "superlattice" coatings are another recently developed, commercially available material made of very thin alternating metallic layers, such as alternating layers of TiN and ZrN, which are repeated to build up a thicker coating. Individual layers are from 30–200 angstroms in thickness. Commercially available coatings include, for example, "nanocrystalline" binary ceramic coatings made by refined cathodic arc technology, applied at a temperature of approximately 750° F. Commercially available multilayered coatings of TiN/ZrN; sometimes referred to as "modulated layer" coatings, are at least 33% harder than conventional monolithic TiN and ZrN coatings due to the alternating, very thin layers of TiN and ZrN utilized. By improving the stiffness of the sealing surfaces, the tendency of the surfaces to deform is lessened, thus providing another desirable feature of the present invention. The superlattice type coatings are also more chemically resistant than conventional coatings. A coating thickness of about 4–7 microns is generally preferred.

In the examples which follow, a series of tests were conducted to compare conventional seal ring pairs with seal ring pairs treated according to the present invention. A special cone and head test fixture utilized spring pressure to force the test parts together in response to an applied pressure. An internal bumper fixture simulated play in the bit similar to that encountered in actual field use. The test fixture was set up and run within a tank containing a water based mud. The test parameters are listed in Table 1 and the wear data which was obtained is presented in Table 2. In each case, one of the seal rings is a conventional, uncoated test ring formed of 440 C steel hardened to approximately 52 or higher on the Rockwell C Scale. The other of the seal rings was coated with a TiN coating on the 440 C substrate, the coating being of a 5 micron thickness.

Table 1 shows the wear data of the seals as measured by weight loss and wear band location. With the Vickers hardness ratio between the harder TiN coated seal face and the softer 440 C seal face at about 4 to 1, the wear was reduced by 76%, 65% and 43% respectively by weight loss depending upon the listed test parameters.

Examination of the surface profiles of the test rings (FIGS. 4–11) show that the TiN/440 C pairs have much less surface irregularities or wear than the 440 C/440 C pairs. The combination of hard on soft material pairs in the metal face seals tested also served to maintain an optimal geometry for the seal rings for increased sealing efficiency.

TABLE 1

Evaluation of Hard on Soft Material Pair for Metal Face Seal Test parameters.

| Test | Material Pair | RPM | Face Load (lb) | Grease Pressure (psi) | Hours | Sand Content in the Mud (lbs) |
|---|---|---|---|---|---|---|
| 22 | 440C/440C | 109 | 142 | 0 | 72 | 5 |
| 23 | TiN/440C | 109 | 136 | 0 | 72 | 5 |
| 24 | 440C/440C | 109 | 134 | 0 | 144 | 5 |
| 25 | TiN/440C | 109 | 136 | 0 | 144 | 5 |
| 32 | 440C/440C | 449 | 150 | 0 | 39 | 5 |
| 33 | TiN/440C | 449 | 164 | 0 | 40 | 5 |

*Test specimen: 3 ⅛" bearing metal face seal EF525.
*Test conducted on seal test machine "B" in water based mud.
*Mud weight: 9.4 lbs/gal.
*Thickness of TiN coating on 440C substrate: 5 μm.
*Coating strength: Vickers microhardness = 2,000 kg/mm$^2$. 440C hardness = 575 kg/mm$^2$.

TABLE 2

Wear data.

| Test | wHSb (gm) | wHSa (gm) | dwHS (gm) | wCSb (gm) | wCSa (gm) | dwCS (gm) | wbHS (in) | wbCS (in) |
|---|---|---|---|---|---|---|---|---|
| 22 | 41.5570 | 41.5252 | 0.0318 | 40.5062 | 40.4806 | 0.0256 | 0.0544 | 0.0456 |
| 23 | 41.7090 | 41.7065 | 0.0025 | 40.3000 | 40.2888 | 0.0112 | 0.0462 | 0.0339 |
| 24 | 41.4865 | 41.3935 | 0.0930 | 40.1738 | 40.0895 | 0.0843 | 0.0778 | 0.0712 |
| 25 | 41.3505 | 41.3421 | 0.0084 | 40.2979 | 40.2448 | 0.0531 | 0.0419 | 0.0494 |
| 32 | 41.5765 | 41.4951 | 0.0814 | 40.2295 | 40.1786 | 0.0509 | 0.0768 | 0.0685 |
| 33 | 40.9890 | 40.9655 | 0.0235 | 40.3965 | 40.3453 | 0.0512 | 0.0527 | 0.0503 |

*wHSb--weight of head seal before test.
wHSa--weight of head seal after test.
dwHS--weight change of head seal before and after test.
wCSb--weight of cone seal before test.
wHSb--weight of cone seal after test.
dwCS--weight change of cone seal before and after test.
wbHS--averaged wear band location of head seal after test.
wbCS--averaged wear band location of head seal after test.

In operation, earth-boring bit 11 is attached to a drillstring (not shown) and run into a borehole for drilling operations. The drillstring and earth-boring bit 11 are rotated, permitting cutters 33 to roll and slide along the bottom of the borehole, wherein inserts or teeth 35 engage and disintegrate formation material. While cutters 33 rotate relative to body 13 of earth-boring bit 11, seal assemblies retain lubricant in bearing cavities 29, promoting the free rotatability of cutters 33 on bearing shafts 31.

Resilient energizer rings 54, 62, 154 maintain rigid seal rings 52, 60, 152 and seal faces 56, 58, 156, 158 in sealing engagement. Seal faces 56, 158 associated with cutter 33 rotate relative to seal faces 58, 156 associated with bearing shaft 31, which remain essentially stationary. Thus, seal faces 56, 58, 156, 158 are in constant sliding contact, and are subject to abrasive and frictional wear.

Rigid face seals having seal faces formed according to the present invention provide increased wear resistance producing fewer surface irregularities and wear and promote an optimal geometry for increased sealing efficiency. These factors combine to provide a seal assembly, and thus an earth-boring bit, having a longer operational life. The ability of the seal assembly to withstand wear and operate longer than prior-art seals permits retention of lubricant in the bearing surfaces for longer period of time, thus resulting in an earth-boring bit having increased life and therefore more economical operation. The superlattice coatings utilized have a hardness which is higher than either constituent material utilized alone. The compositional layering can be designed to provide improved mechanical properties and corrosion resistance.

The present invention has been described with reference to a preferred embodiment thereof. Those skilled in the art will appreciate that the invention is thus not limited, but is susceptible to variation and modification without departure from the scope and spirit thereof.

What is claimed is:

1. An earth-boring bit with an improved mechanical face seal assembly, the earth-boring bit comprising:

a bit body;

at least one cantilevered bearing shaft, including a base and a bearing surface, extending inwardly and downwardly from the bit body;

at least one cutter mounted for rotation on the cantilevered bearing shaft;

a seal assembly disposed between the bearing shaft and the cutter and proximally to the base of the cantilevered bearing shaft, the seal assembly including at least one rigid seal ring having a seal face in contact with a second seal face, at least one of the seal faces being at least partially formed of a hard ceramic type material; and wherein the first seal face is formed of the hard ceramic type material and wherein the second seal face is a radial seal face on a second rigid seal ring, the second seal face being formed of a relatively softer material than the hard ceramic type material on the first rigid seal ring; and wherein the radial seal face is formed with a spherical radius leading to a flat which gives the radial seal face a taper.

2. The earth-boring bit of claim 1, wherein the hard ceramic type material is selected from the group consisting of metal nitrides, metal carbides, carbon nitrides and nitride superlattices.

3. The earth-boring bit of claim 2, wherein the relatively softer, second seal face is formed of a material selected from the group consisting of iron and cobalt and alloys thereof.

4. The earth-boring bit of claim 3, wherein the hard ceramic type material used for the first seal face is TiN and the relatively softer, second seal face is formed of tempered stainless steel.

5. The earth-boring bit of claim 4, wherein the hard ceramic type material used for the first seal face is a nitride superlattice and the relatively softer, second seal face is formed of tempered stainless steel.

6. An earth-boring bit with an improved mechanical face seal assembly, the earth-boring bit comprising:

a body;

a cantilevered bearing shaft extending obliquely inwardly and downwardly from the body;

a cutter secured for rotation about the bearing shaft, with axial and radial play due to clearances;

a lubrication system in the body, including a hydrostatic pressure compensator;

a seal groove including a pair of oppositely facing circumferential walls, one located on the cutter and the other on the bearing shaft, each of which intersects a generally radial end wall;

a pair of rigid rings positioned in the seal groove to have opposed, sealing faces;

a pair of resilient energizer rings, each of which sealingly engages a respective one of the rigid rings, and continuously engages one of the oppositely facing circumferential walls of the seal groove to define a seal assembly positioned in between the end walls of the seal groove;

the seal assembly being positioned intermediate the end walls of the groove during assembly of the cutter on the bearing shaft and exposed to and moved by dynamic pressure differentials between the lubricant and the ambient drilling fluids;

wherein the pair of rigid rings define first and second seal faces, the first seal face being formed of a hard ceramic type material and the second seal face comprising a radial seal face formed of a relatively softer material than the hard ceramic type material of the first seal face; and wherein the radial seal face is formed with a spherical radius leading to a flat which gives the radial seal face a taper.

7. The earth-boring bit of claim 6, wherein the hard ceramic type material is selected from the group consisting of metal nitrides, metal carbides, carbon nitrides and nitride superlattices.

8. The earth-boring bit of claim 6, wherein the relatively softer, second seal face is formed of a material selected from the group consisting of iron and cobalt and alloys thereof.

9. The earth-boring bit of claim 6, wherein the hard ceramic type material used for the first seal face is TiN and the relatively softer, second seal face is formed of tempered stainless steel.

10. An earth-boring bit with an improved mechanical face seal assembly, the earth-boring bit comprising:

a bit body;

at least one cantilevered bearing shaft, including a base and a bearing surface, extending inwardly and downwardly from the bit body;

at least one cutter mounted for rotation on the cantilevered bearing shaft;

a seal assembly disposed between the bearing shaft and the cutter and proximally to the base of the cantilevered bearing shaft, the seal assembly including at least one rigid seal ring having a seal face in contact with a second seal face, at least one of the seal faces being at least partially formed of a hard ceramic type material;

wherein the first seal face is formed of the hard ceramic type material and wherein the second seal face is on the cutter of the earth-boring bit, the second seal face being formed of a relatively softer material than the hard ceramic type material on the first rigid seal ring; and wherein the radial seal face is formed with a spherical radius leading to a flat which gives the radial seal a taper.

* * * * *